US006941657B2

(12) United States Patent
Choi et al.

(10) Patent No.: US 6,941,657 B2
(45) Date of Patent: Sep. 13, 2005

(54) NAIL CLIPPERS

(76) Inventors: Young-Sik Choi, Chumdandongbu Apt. 105-602, 757-3 Wolgye-dong-Kwangsan-gu, Kwangju (KR), 506-821; Yong-Sik Choi, Daewoo Apt. 311-302 Yeonggodmaeul, Yeonsungjigu, Hasang-dong, Siheungshi, Kyungki-do (KR), 429-270

( * ) Notice: Subject to any disclaimer, the term of this patent is extended or adjusted under 35 U.S.C. 154(b) by 0 days.

(21) Appl. No.: 10/480,726

(22) PCT Filed: Apr. 23, 2002

(86) PCT No.: PCT/KR02/00749

§ 371 (c)(1),
(2), (4) Date: May 28, 2004

(87) PCT Pub. No.: WO02/102184

PCT Pub. Date: Dec. 27, 2002

(65) Prior Publication Data

US 2004/0205968 A1 Oct. 21, 2004

(30) Foreign Application Priority Data

Jun. 20, 2001 (KR) ..... 10-2001-0035053

(51) Int. Cl.[7] ..... A45D 29/02

(52) U.S. Cl. ..... 30/28; 132/75.5

(58) Field of Search ..... 30/26, 28; 132/73, 132/73.5, 75.3, 75.4, 75.5; D28/56, 60

(56) References Cited

U.S. PATENT DOCUMENTS

| | | | | | |
|---|---|---|---|---|---|
| 1,836,557 | A | * | 12/1931 | Seymoure | 132/75.5 |
| 2,774,138 | A | * | 12/1956 | Gowdey | 30/28 |
| 3,042,047 | A | * | 7/1962 | Plaskon | 132/75.5 |
| 3,555,675 | A | * | 1/1971 | Jurena | 30/28 |
| 4,648,415 | A | * | 3/1987 | Yuan | 132/73 |
| 4,982,747 | A | * | 1/1991 | Shah | 132/75.5 |
| 5,063,666 | A | * | 11/1991 | Tsay | 30/28 |
| 5,307,824 | A | * | 5/1994 | Bannett | 132/75.5 |
| 5,522,136 | A | * | 6/1996 | Larisey | 30/28 |

* cited by examiner

*Primary Examiner*—Hwei-Siu Payer
(74) *Attorney, Agent, or Firm*—Rutan & Tucker, LLP

(57) ABSTRACT

A nail clipper has an operation grip part pressurizing a cutting edge that can be freely rotated with respect to the body and moved along the surface of the body, thereby allowing a user to clip his or her nails with ease.

11 Claims, 11 Drawing Sheets

NAIL CLIPPERS

TECHNICAL FIELD

The present invention relates to nail clippers, and more particularly, to nail clippers that are provided with an operation grip part pressurizing a cutting edge that can be freely rotated with respect to a body and moved along the surface of the body, thereby allowing a user to clip his or her nails with ease.

BACKGROUND ART

A nail clipper generally includes a body that has upper and lower steel plates connected on one end parts and opened on the other end parts on which are formed a cutting edge, and a pressurizing bar placed on one of the upper and lower steel plates of the body and thus connected with the body by virtue of a support shaft. In operation, if the pressurizing bar is depressed, the support shaft is pulled by the operation of the lever protrusion of the pressurizing bar, which allows the cutting edges to become in contact with each other so that the nail between the cutting edges can be clipped.

However, since the conventional nail clippers work only in a manner that the pressurizing bar is positioned in a straight line against the body, a user should turn the body along his or her nails rounded in the arc shape at the time of nail-clipping, which of course makes him or her feel that it is inconvenient to use.

DISCLOSURE OF INVENTION

To solve the above-described problems, it is an object of the present invention to provide nail clippers that are provided with an operation grip part pressurizing a cutting edge that can be freely rotated with respect to a body and moved along the surface of the body, thereby allowing a user to clip his or her nails with ease.

To accomplish this and other objects of the present invention, there is provided nail clippers that includes: a body provided with upper and lower steel plates that are spaced upward and downward at a predetermined distance, having an one end part on which cutting edges for clipping nails are formed, and forming through holes on the sides adjacent to the cutting edges; an operation grip part that has a pair of pressurizing bars, which are tightly disposed on the outer surfaces of the upper and lower steel plates for pressurizing the upper and lower steel plates to face the cutting edges, provided with coupling holes that correspond to the through holes of the upper and lower steel plates and a lever protrusion that is formed on one of the pair of pressurizing bars to correspond to any one surface of the upper and lower steel plates; and a support shaft that is passed through the through holes of the upper and lower steel plates and the coupling holes of the operation grip part that are in a line, for supporting the operation grip part to be axially rotated with respect to the body.

According to the present invention, the upper and lower steel plates have one end parts that are in close contact with other such that another end parts on which the cutting edges are formed come elastically in contact with each other, in the state where they are opened, and the support shaft is adopted to be passed through the through holes of the upper and lower steel plates and the coupling holes of the operation grip part and coupled with the coupling hole of the one of the pair of pressurizing bars and forms a screw thread for adjusting the length thereof, on the outer peripheral surface thereof.

According to the present invention, the upper and lower steel plates are supported in parallel relation to each other, by means of a spring, such that the cutting edges of the one end parts thereof face elastically to each other.

According to the present invention, each of the upper and lower steel plates forms a guide rail that is extended from the through hole and is passed through the surface thereof, for moving the operation grip part, the guide rail forming a plurality of station holes to stop the operation grip part and rotate it to be perpendicular to the body so that it is compressively operated, on predetermined portions thereof, and the upper and lower steel plates of the body forming cutting edges on the sides corresponding to the plurality of station holes, the cutting edges on the sides facing each other for nail-clipping as the operation grip part is depressed.

According to the present invention, the outer peripheral surface of the support shaft is cut proper for the width of the guide rail such that when it reaches one of the station holes, along the guide rail, and is then rotated, it is fixedly supported in each of the station holes.

According to the present invention, the cutting edges formed on the body have different curved shapes such that the shapes of the nails clipped are different from each other.

According to the present invention, one of the upper and lower steel plates forms a bent portion that is adjacent to the one cutting edge on the sides of the body and bent toward the space portion between the upper and lower steel plates, the bent portion forming a coupling hole through which a coupling member is inserted, the coupling member connected with a stop bar on a front end thereof, for moving forwardly and backwardly in a width direction of the body corresponding to the length of the nail, thereby protecting the nail from coming in the space portion between the upper and lower steel plates.

According to the present invention, the operation grip part forms on a rear end part thereof trimming lines that cover only the rough surface of the nail clipped to trim it.

According to the present invention, the rear end part of the operation grip part on which the trimming lines are formed is attachable and detachable to/from the operation grip part.

According to the present invention, the cutting edges of the body are attachable and detachable to/from the body.

According to the present invention, the lower steel plate of the body forms a support part that is protruded upwardly on the outer peripheral portion of the through hole thereof, the support part stopping the descending of the upper steel plate when the upper steel plate is descended by the pressurizing of the operation grip part so that the cutting edges of the upper and lower steel plates are in sufficiently close contact with the nail to clip the nail, thereby protecting the cutting edges from being damaged.

BRIEF DESCRIPTION OF THE DRAWINGS

Further objects and advantages of the invention can be more fully understood from the following detailed description taken in conjunction with the accompanying drawings, in which.

BEST MODE FOR CARRYING OUT THE INVENTION

Now, an explanation of the preferred embodiment of the present invention will be made with reference to accompanying drawings.

Figure 1:
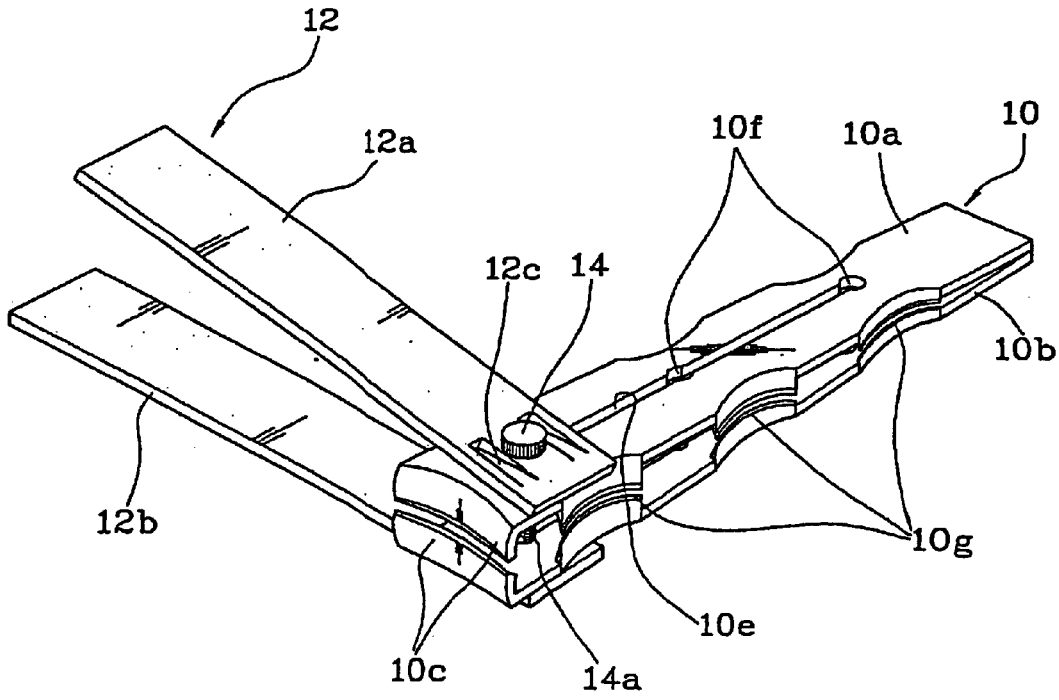
FIG. 1 is a perspective view showing a nail clipper according to a first embodiment of the present invention.
Figure 1A:
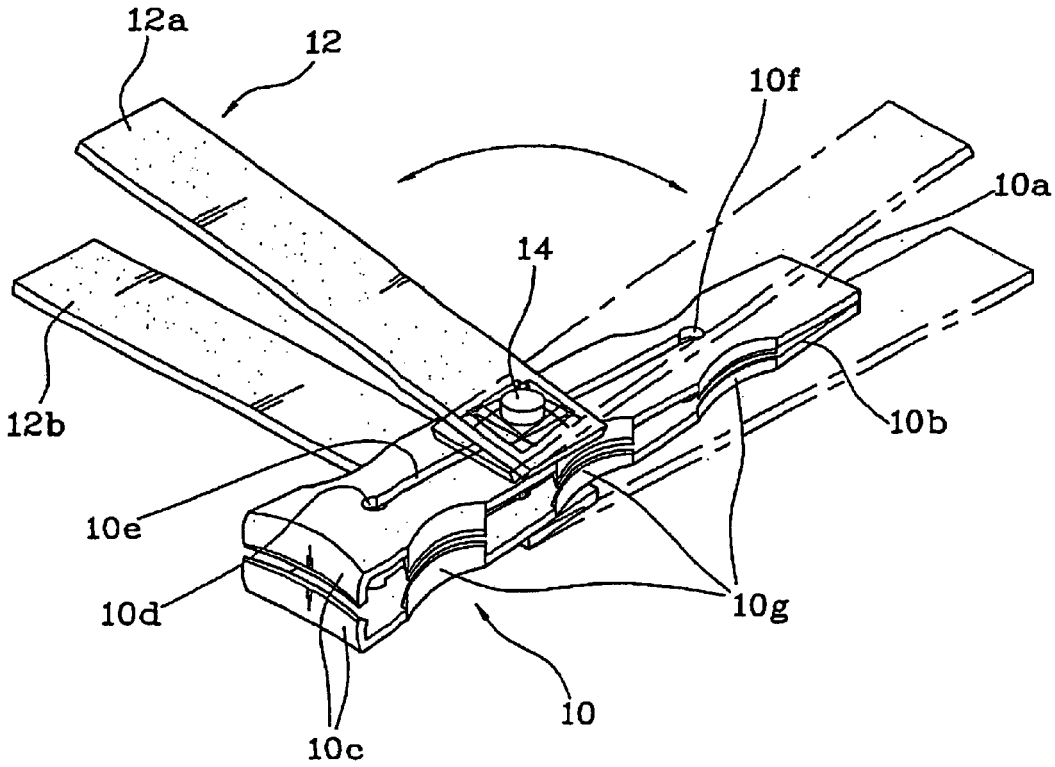
FIG. 1*a* is a perspective view showing the operation example of the nail clipper according to the present invention.

As shown in FIGS. 1 and 1*a*, a nail clipper according to the present invention includes a body 10 having upper and lower steel plates 10*a* and 10*b*, an operation grip part 12 disposed in close contact with the outsides of the upper and lower steel plates 10*a* and 10*b*, and a support shaft 14 for supporting the operation grip part 12 such that the operation grip part 12 rotates with respect to the body 10.

The upper and lower steel plates 10*a* and 10*b* of the body 10, which are generally rectangular shaped members, are connected on one end parts and spaced by a predetermined distance on another end parts, each provided with cutting edges 10*c*. The end parts provided with the cutting edge 10*c* thereon come in contact with each other by the application of an external force and are elastically opened, then. The upper and lower steel plates 10*a* and 10*b* are provided with a through hole 10*d* that is formed in a line with the support shaft 14 on the surfaces of the steel plates corresponding to the sides adjacent to the cutting edges 10*c*, such that the support shaft 14 is passed through the through hole 10*d*.

The upper and lower steel plates 10*a* and 10*b* are also provided with a guide rail 10*e* that is passed through the surfaces thereof and extended from the through hole 10*d*, for moving the operation grip part 12 connected to the support shaft 14. The guide rail 10*e* forms a plurality of station holes 10*f* in which the moving operation grip part 12 stops and rotates to be perpendicular to the body 10, on predetermined portions thereof, and the upper and lower steel plates 10*a* and 10*b* of the body 10 form a plurality of cutting edges. 10*g* on the sides corresponding to the plurality of station holes 10*f*, the cutting edges 10*g* facing each other for nail-clipping as the operation grip part 12 is depressed.

The guide rail 10*e* is relatively a small passage enough to guide the outer peripheral surface of the support shaft 14 that is cut on the face thereof to have a generally small diameter, and when the support shaft 14 reaches one of the station holes 10*f*, the corresponding station hole 10*f* serves to rotate the operation grip part 12 such that the outer peripheral surface of the support shaft 14 having a generally large diameter is located toward the guide rail 10*e*, thereby preventing the support shaft 14 from moving.

The cutting edges 10*c* and log on the body 10 have such the shape and strength that they clip a corresponding nail or toenail by the only one operation of the operation grip part 12.

Figure 2:
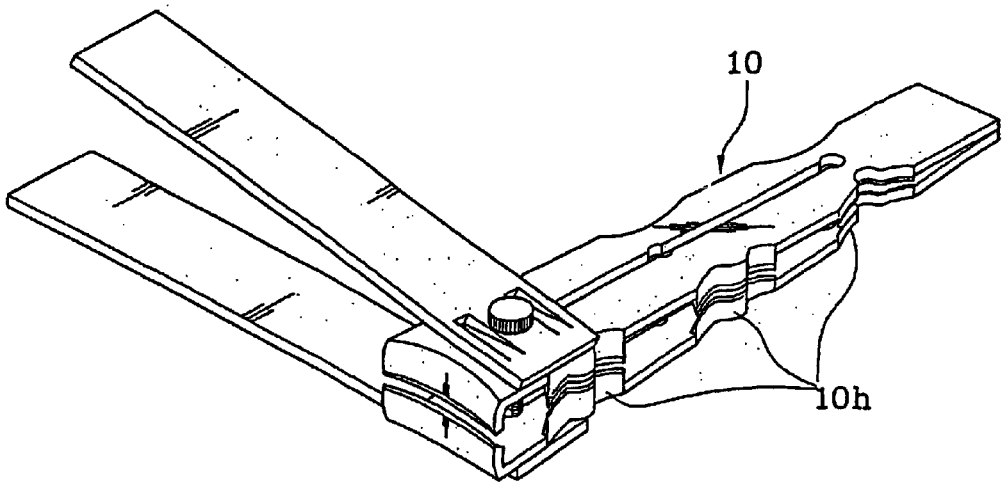
FIG. 2 is a perspective view showing a nail clipper according to a second embodiment of the present invention, wherein cutting edges have different shapes.

As shown in FIG. 2, the cutting edges 10*h* on the front end part and the sides of the body 10 are formed in various curved shapes such that the shapes of the nails clipped are different from each other.

The support shaft 14 is formed passing through the coupling hole (not shown) of the operation grip part 12 and the through hole 10*d* of the body 10 so that the operation grip part 12 is axially rotatable with respect to the body 10. The support shaft 14 is provided with a screw thread 14*a* on the outer peripheral surface thereof such that it is passed through a pressurizing bar 12*a* of the operation grip part 12 on which a lever protrusion 12*c* is formed, and it is coupled with the screw thread 14*a* to a pressurizing bar 12*b* of the operation grip part 12 on which lever protrusion 12*c* is not formed.

In this case, in order to prevent the gap between the upper and lower steel plates 10*a* and 10*b* from being substantially narrowed as the support shaft 14 moves to a rear end part of the body 10 along the guide rail 10*e*, the support shaft 14 is appropriately fastened and loosed such that the pressurizing bars 12*a* and 12*b* can be tightly closed on each surface of the upper and lower steel plates 10*a* and 10*b*.

The operation grip part 12 has the pair of pressurizing bars 12*a* and 12*b* that are tightly disposed on the outer surfaces of the upper and lower steel plates 10*a* and 10*b*, the coupling holes (not shown) that are in a straight line with the through holes 10*d* of the upper and lower steel plates 10*a* and 10*b* on the front end parts thereof, and the lever protrusion 12*c* that is formed on one of the pair of pressurizing bars 12*a* and 12*b*, so as to pull the support shaft 14 upon operation of the operation grip part 12 and to face the cutting edges 10*c* of the body 10 each other at the same time.

The support shaft 14 is directly passed through the coupling hole of the pressurizing bar 12*a* on which the lever protrusion 12*c* is formed, and the screw thread 14*a* of the support shaft 14 is coupled with the coupling hole of the pressurizing bar 12*b* on which the lever protrusion 12*c* is not formed, which allows the length of the support shaft 14 to be adjusted, while making the pressuring bars 12*a* and 12*b* of the operation grip part 12 come in contact with the upper and lower steel plates 10*a* and 10*b*.

Figure 3:
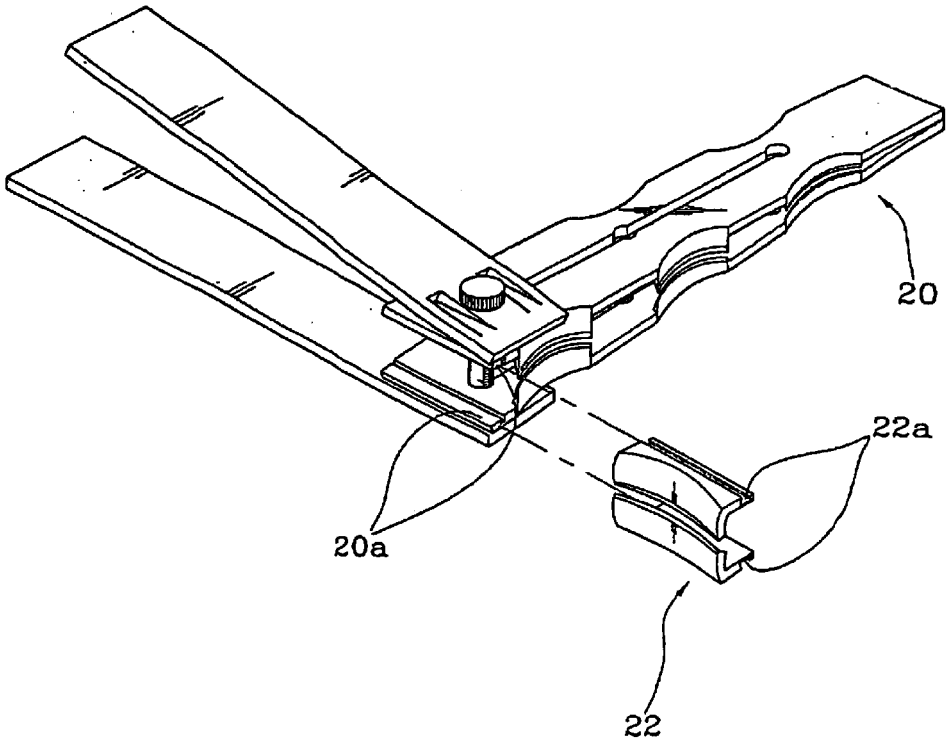
FIG. 3 is a perspective view showing a nail clipper according to a third embodiment of the present invention, wherein cutting edges of the body are separated.

In the state that a cutting edge 22 of a body 20 is separated from the body 20, as shown in FIG. 3, it can be attachable and detachable to/from the front end part of the body 20. This is achieved by forming a coupling groove 22*a* on the cutting edge 22 and a coupling protrusion 20*a* on the body 20, so that they are attached and detached each other. At that time, the coupling protrusion 20*a* is in the shape of a regular triangle and the coupling groove 22*a* is in the shape of a reverse triangle, strongly engaged each other to prevent their separation.

Figure 4:
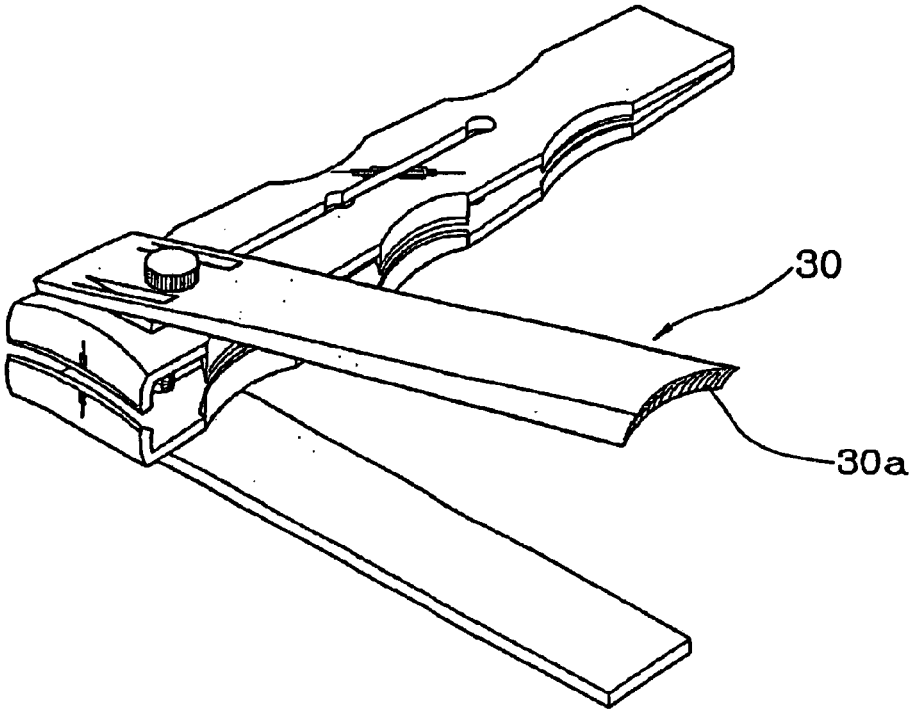
FIG. 4 is a perspective view showing a nail clipper according to a fourth embodiment of the present invention, wherein the operation grip part forms trimming lines on the end part thereof.

As shown in FIG. 4, a rear end part of the operation grip part 30 forms trimming line 30*a* that takes a generally one fourth arc shape to cover only the rough surface of the nail clipped for trimming it.

Figure 4A:
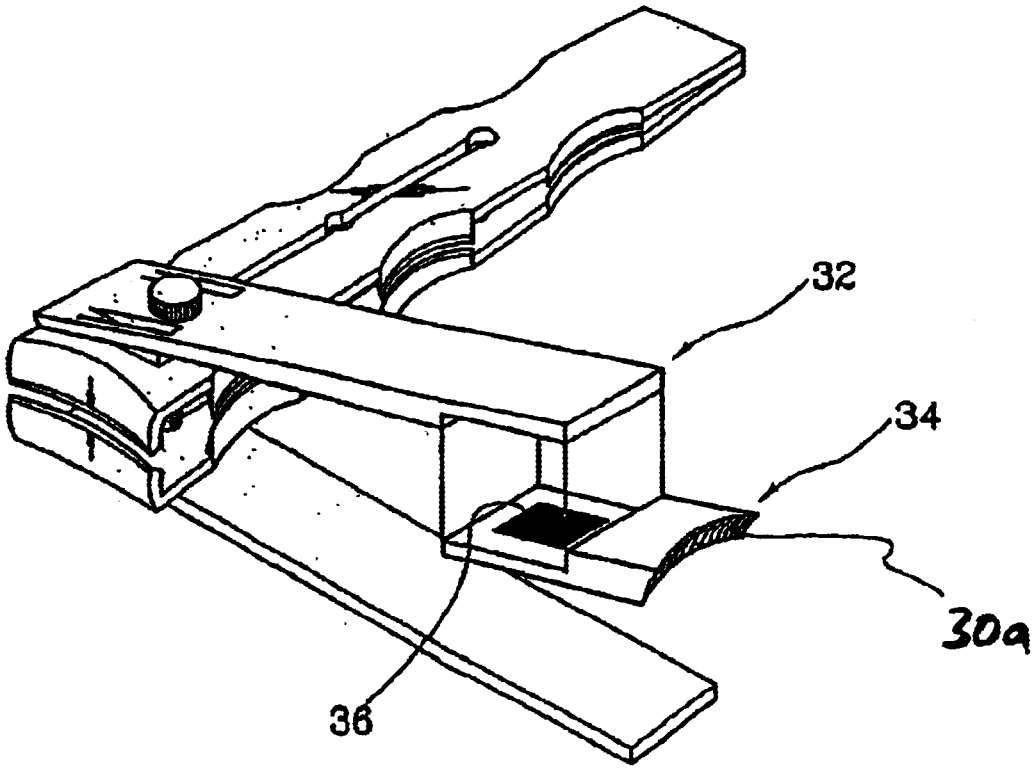
FIG. 4*a* is a perspective view showing the nail clipper of FIG. 4, wherein the rear end part of the operation grip part, on which the trimming lines are formed, is separated.

In case of trimming the cut face of the nail clipped, as shown in FIG. 4*a*, only the rear 200 end part 34 of an operation grip part 32 on which a trimming line 30*a* is formed is separated. That is, the rear end part 34 is attachable and detachable to/from the operation grip part 32, such that the nail trimming is carried out with ease. In this case, the coupling of the rear end part 34 with the operation grip part 32 is achieved by means of a bonding part 36 such as a magnet that is provided on the surfaces corresponding to each other.

Figure 5:
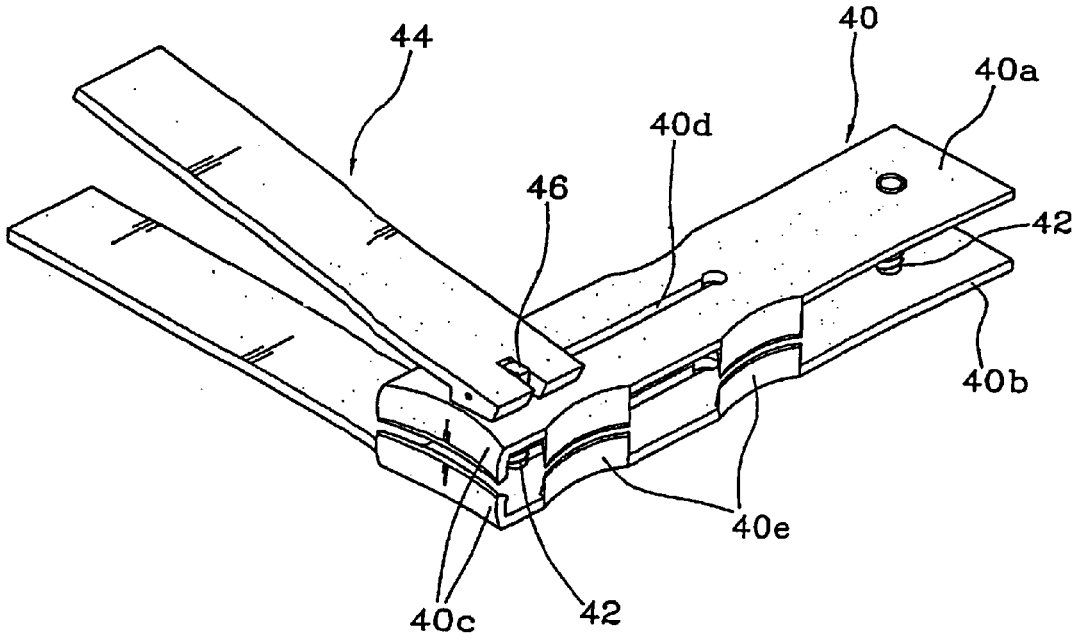
FIG. 5 is a perspective view showing a nail clipper according to a fifth embodiment of the present invention, wherein the upper and lower steel plates are supported by a spring.
Figure 6:
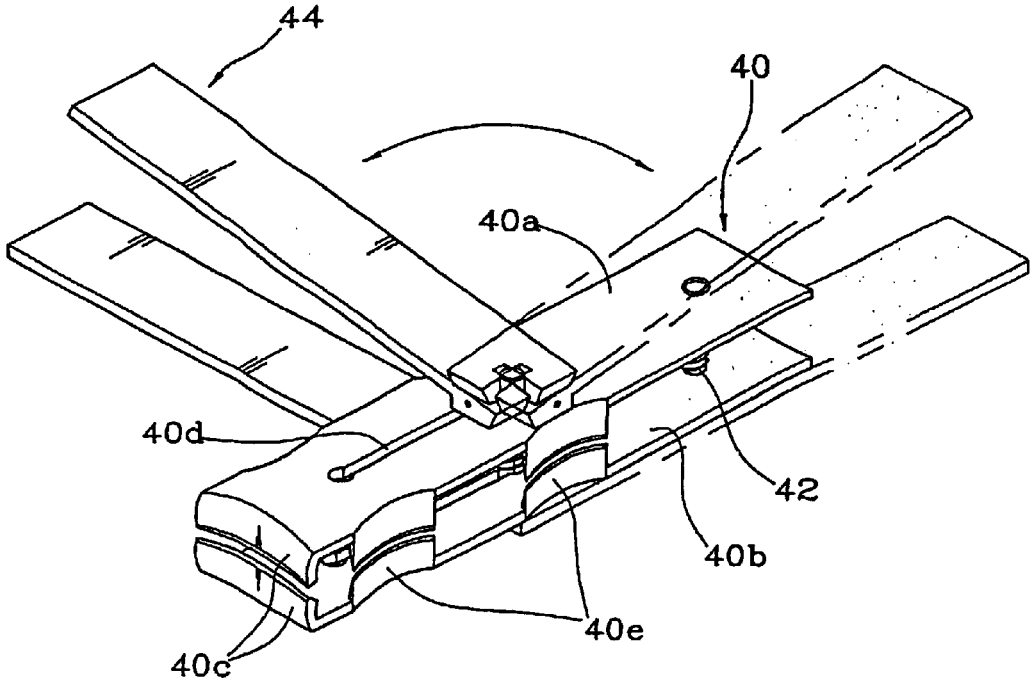
FIG. 6 is a perspective view showing the operation example for the nail clipper of FIG. 5.

On the other hand, the one end parts of the upper and lower steel plates 10*a* and 10*b* of the body 10 are connected in a welding manner and the another end parts thereof face each other by the elasticity of the steel plate and are then separated by a predetermined distance. Besides, as shown in FIGS. 5 and 6, upper and lower steel plates 40*a* and 40*b* of a body 40 are disposed in parallel relation to each other and between the upper and lower steel plates 40*a* and 40*b* is provided with a spring 42 that enables a cutting edge 40*c* to be elastically operated if an operation grip part 44 is depressed. In case of installing the spring 42, the upper and lower steel plates 40*a* and 40*b* are in parallel relation to each other such that when a support shaft 46 is moved along a guide rail 40*d* for using the cutting edges 40*e* on the sides of the body 40, it does not need to be adjusted in length. In this case, therefore, the support shaft 46 with no screw thread thereon is desirably employed.

Figure 7:
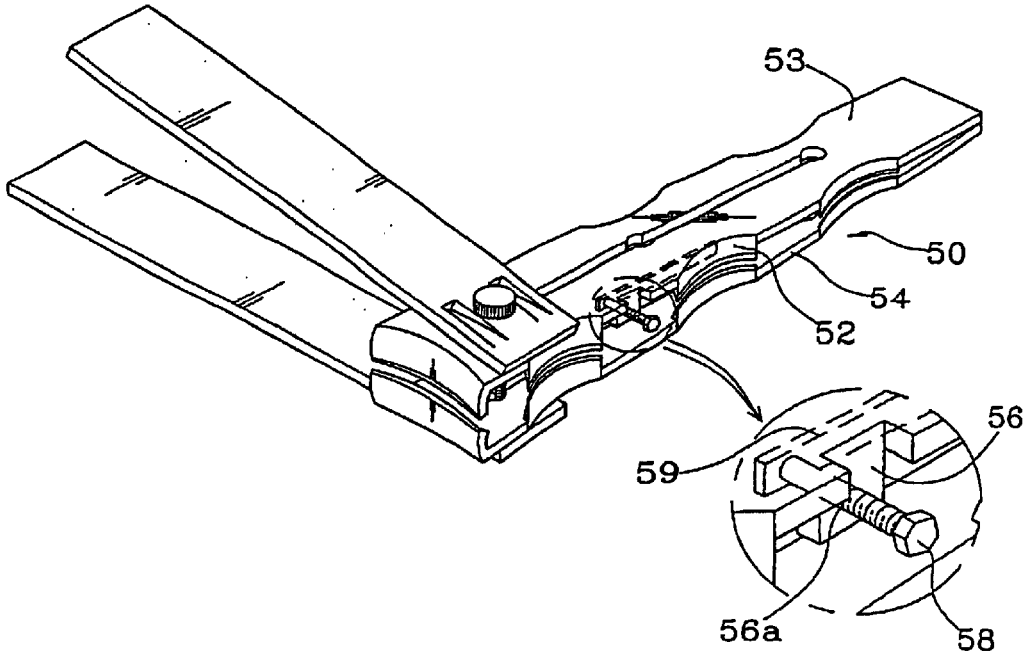
FIG. 7 is a perspective view showing a nail clipper according to a sixth embodiment of the present invention, wherein the upper and lower steel plates form a stop bar between them.

As shown in FIG. 7, an upper steel plate 53 forms a bent portion 56 that is adjacent to the one cutting edge 52 on the sides of the upper and lower steel plates 53 and 54 of a body 50 and located toward the space portion between the upper and lower steel plates 53 and 54, the bent portion 56 forming a coupling hole 56*a* through which a coupling member 58 is inserted, the coupling member 58 connected with a stop bar 59 on a front end thereof, for moving forwardly and backwardly in a width direction of the body 50 corresponding to the length of the nail thereby protecting the nail from coming in the space portion between the upper and lower steel plates 53 and 54. In this case, the stop bar 59 may be arranged corresponding to each of the cutting edges 52, or may be formed for only the single cutting edge 52.

Figure 8:
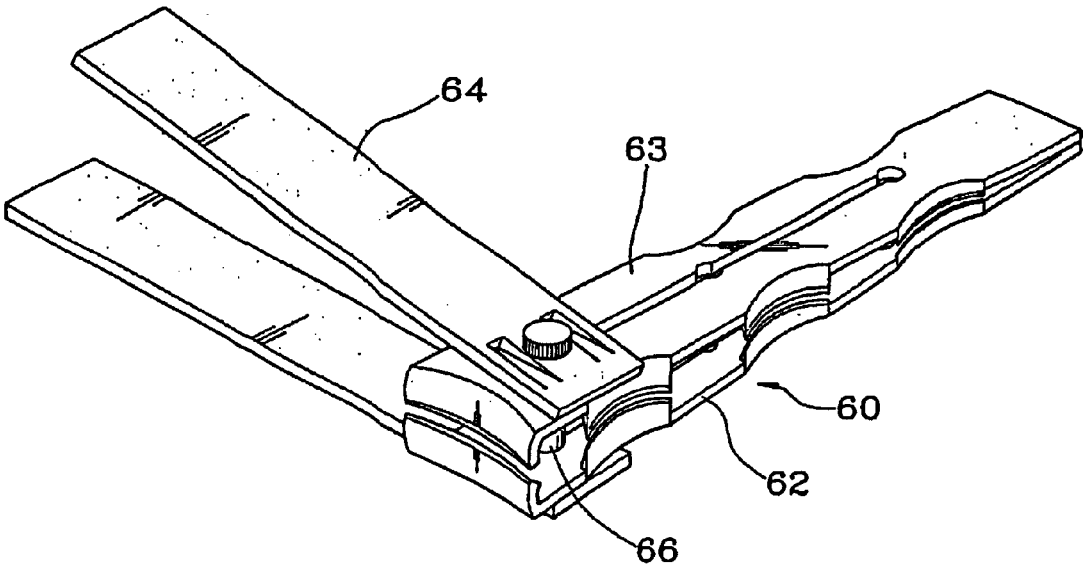
FIG. 8 is a perspective view showing a nail clipper according to a seventh embodiment of the present invention, wherein the lower steel plate forms a support part around the outer peripheral surface of the through hole thereof.
Figure 8A:
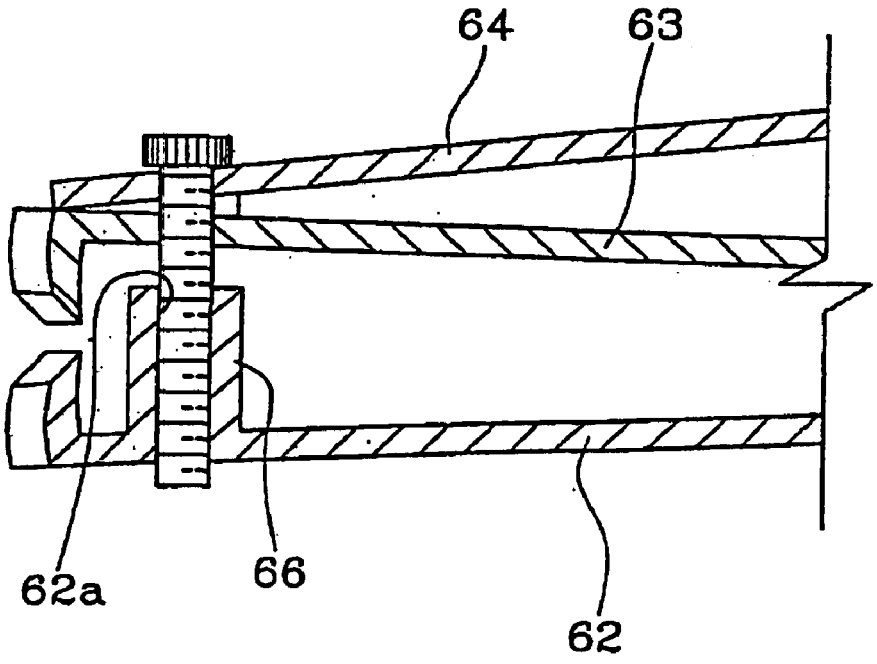
FIG. 8*a* is a partly sectional view showing the principal parts of FIG. 8.

As shown in FIGS. 8 and 8*a*, a lower steel plate 62 of a body 60 forms a support part 66 that is protruded upwardly on the outer peripheral portion of a through hole 62*a* thereof, the support part 66 stopping the descending of an upper steel plate 63 when the upper steel plate 63 is descended by the pressurizing of an operation grip part 64 so that the cutting edges are in sufficiently close contact with the nail to clip the nail, thereby protecting the cutting edges from being damaged.

Under the above-mentioned configurations of the nail clippers according to the preferred embodiments of the present invention, in case of nail-clipping by using the cutting edges 10*c* formed on the one end parts of the body 10, the operation grip part 12 is in parallel relation to the body 10 and as the operation grip part 12 is depressed, the cutting edges 10*c* face each other and clip the desired nail. In case of clipping the edge portions of the nail, the operation grip part 12 rotates to an appropriate position with respect to the body 10, without facing the body 10 itself toward the edge portions of the nail.

In case of using the cutting edges 10*g* formed on the sides of the body 10, the operation grip part 12 is in parallel relation to the body 10 and then, the support shaft 14 is moved along the guide rail 10*e* to a position where the desired cutting edge 10*g* is placed. When the support shaft 14 reaches the corresponding station hole 10*f*, the operation grip part 12 is rotated and placed in a perpendicular line to the body 10, and at this state, the clipping is achieved. While the support shaft 14 is moved along the guide rail 10*e*, the outer peripheral surface of the support shaft 14 having the relatively small diameter is moved toward the guide rail 10*e*, and on the contrary, if it reaches the corresponding station hole 10*f*, the outer peripheral surface of the support shaft 14 having the relatively large diameter is moved toward the guide rail 10*e*, such that the support shaft 14 is not moved to the side portion of the station hole 10*f*.

As the operation grip part 12 is moved along the guide rail 10*e* to a desired position, the cutting edge 10*g* corresponding to the desired position serves to clip the desired nail. And, since the cutting edges 22 that are formed on the one end parts of the body 20 are attachable and detachable to/from the body 20, they can be exchanged into new ones any time, and the trimming line 30*a* that is formed on the rear end part of the operation grip part 3D serves to trim the cut face of the nail clipped in an accurate manner.

INDUSTRIAL APPLICABILITY

As set forth in the foregoing, nail clippers according to'the present invention that are provided with an operation grip part that can be freely rotated with respect to a body and further moved along the surface of the body, thereby allowing a user to clip his or her nails with more ease.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A nail clipper comprising:

a body provided with upper and lower steel plates that are spaced upward and downward at a predetermined distance, a cutting edge formed on an end part of each said plate for clipping nails, and through holes formed on the sides adjacent to said cutting edges;

an operation grip part having a pair of pressurizing bars that are tightly disposed on the outer surfaces of said upper and lower steel plates for pressurizing said upper and lower steel plates to face said cutting edges and have coupling holes that correspond to said through holes of said upper and lower steel plates and a lever protrusion that is formed on one of said pair of pressurizing bars to correspond to any one surface of said upper and lower steel plates; and a support shaft passed through said through holes of said upper and lower steel plates and said coupling holes of said operation grip part that are in a line for supporting said operation grip part to be axially rotated with respect to said body.

2. The nail clipper according to claim 1, wherein said upper and lower steel plates have one end parts that are in close contact with each other such that another end parts thereof on which said cutting edges are formed come elastically in contact with each other, in the state where they are opened, and said support shaft is adopted to be passed through said through holes of said upper and lower steel plates and said coupling holes of said operation grip part and coupled with said coupling hole of the one of said pair of pressurizing bars and forms a screw thread for adjusting the length thereof, on the outer peripheral surface thereof.

3. The nail clipper according to claim 1, wherein said upper and lower steel plates are supported in parallel relation with each other, by means of a spring, such that said cutting edges of the one end parts thereof face elastically to each other.

4. The nail clipper according to claim 2 or 3, wherein each of said upper and lower steel plates forms a guide rail that is extended from said through hole and is passed through the surface thereof, for moving said operation grip part, said guide rail forming a plurality of station holes to stop said operation grip part and rotate it to be perpendicular to said body so that said operation grip part is compressively operated, on predetermined portions thereof, and said upper and lower steel plates of said body forming cutting edges on the sides corresponding to said plurality of station holes, said cutting edges facing to each other for nail-clipping as said operation grip part is depressed.

5. The nail clipper according to claim 4, wherein the outer peripheral surface of said support shaft is cut proper for the width of said guide rail such that when said support shaft reaches one of said station holes, along said guide rail and is then rotated, it is fixedly supported in each of said station holes.

6. The nail clipper according to claim 4, wherein said cutting edges formed on said body have different curved shapes such that the shapes of the rails clipped are different from each other.

7. The nail clipper according to claim 4, wherein one of said upper and lower steel plates forms a bent portion that is adjacent to at least one of the cutting edges on the sides of said body and bent toward the space portion between said upper and lower steel plates, said bent portion forming a coupling hole through which a coupling member is inserted, said coupling member connected with a stop bar on the front end thereof, for moving forwardly and backwardly in a width direction of said body corresponding to the length of the nail, thereby protecting the nail from coming in the space portion between said upper and lower steel plates.

8. The nail clipper according to claim 1, wherein said operation grip part forms, on the rear end part thereof, trimming lines that cover only the rough surface of the nail clipped to trim it.

9. The nail clipper according to claim 8, wherein the rear end part of said operation grip part on which said trimming lines are formed is attachable and detachable to/from said operation grip part.

10. The nail clipper according to claim 1, wherein said cutting edges of said body are attachable and detachable to/from said body.

11. The nail clipper according to claim 4, wherein said lower steel plate of said body forms a support part that is protruded upwardly on the outer peripheral portion of said through hole thereof, said support part stopping the descending of said upper steel plate when said upper steel plate is descended by the pressurizing of said operation grip part so that said cutting edges of said upper and lower steel plates are in suffciently close contact with the nail to clip the nail, thereby protecting said cutting edges from being damaged.

* * * * *